US007108387B1

(12) United States Patent
Lucas

(10) Patent No.: US 7,108,387 B1
(45) Date of Patent: Sep. 19, 2006

(54) DOORKNOB AND LOCK LIGHT ASSEMBLY

(76) Inventor: Daniel D. Lucas, 7050 Green Acre La., Fort Myers, FL (US) 33912

( * ) Notice: Subject to any disclaimer, the term of this patent is extended or adjusted under 35 U.S.C. 154(b) by 35 days.

(21) Appl. No.: 10/998,961

(22) Filed: Nov. 30, 2004

(51) Int. Cl.
*E05B 17/10* (2006.01)

(52) U.S. Cl. ..... 362/100; 362/802; 70/432; 200/61.62

(58) Field of Classification Search ..... 362/100, 362/802; 70/432; 200/61, 62
See application file for complete search history.

(56) References Cited

U.S. PATENT DOCUMENTS 6,622,537 B1 * 9/2003 Rodriguez ..... 362/100
6,729,740 B1 * 5/2004 Gazard ..... 362/100
2004/0085755 A1 * 5/2004 Dupont ..... 362/100

* cited by examiner

*Primary Examiner*—Stephen Husar
*Assistant Examiner*—Meghan K. Dunwiddie

(57) ABSTRACT

A doorknob and lock light assembly for providing a useful light when for a user attempting to place a key in the lock. The doorknob and lock light assembly includes a door lock assembly including a handle being adapted to be securely attached to a door; and also includes a light-emitting assembly being attached to the door lock assembly and including a battery being disposed in the handle and also including light-emitting members being attached to the handle and being connected with wires to the battery; and further includes a sensor/switch assembly being attached to the door lock assembly and being connected to the battery.

4 Claims, 4 Drawing Sheets

DOORKNOB AND LOCK LIGHT ASSEMBLY

BACKGROUND OF THE INVENTION

1. Field of the Invention

The present invention relates to doorknob and lock lighting arrangements and more particularly pertains to a new doorknob and lock light assembly for providing a useful light when for a user attempting to place a key in the lock.

2. Description of the Prior Art

The use of doorknob and lock lighting arrangements is known in the prior art. More specifically, doorknob and lock lighting arrangements heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,398,175; U.S. Pat. No. 5,712,615; U.S. Pat. No. 6,278,366; U.S. Pat. No. 4,981,314; U.S. Pat. No. 5,008,551; and U.S. Patent No. Des. 338,735.

While these devices fulfill their respective, particular objectives and requirements, the aforementioned patents do not disclose a new doorknob and lock light assembly. The prior art includes doorknobs having lights disposed therein.

SUMMARY OF THE INVENTION

The general purpose of the present invention, which will be described subsequently in greater detail, is to provide a new doorknob and lock light assembly which has many of the advantages of the doorknob and lock lighting arrangements mentioned heretofore and many novel features that result in a new doorknob and lock light assembly which is not anticipated, rendered obvious, suggested, or even implied by any of the prior art doorknob and lock lighting arrangements, either alone or in any combination thereof. The present invention includes a door lock assembly including a handle being adapted to be securely attached to a door; and also includes a light-emitting assembly being attached to the door lock assembly and including a battery being disposed in the handle and also including light-emitting members being attached to the handle and being connected with wires to the battery; and further includes a sensor/switch assembly being attached to the door lock assembly and being connected to the battery.

There has thus been outlined, rather broadly, the more important features of the doorknob and lock light assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new doorknob and lock light assembly which has many of the advantages of the doorknob and lock lighting arrangements mentioned heretofore and many novel features that result in a new doorknob and lock light assembly which is not anticipated, rendered obvious, suggested, or even implied by any of the prior art doorknob and lock lighting arrangements, either alone or in any combination thereof.

Still another object of the present invention is to provide a new doorknob and lock light assembly for providing a useful light when for a user attempting to place a key in the lock.

Still yet another object of the present invention is to provide a new doorknob and lock light assembly that is easy and convenient to use.

Even still another object of the present invention is to provide a new doorknob and lock light assembly that allows a user to quickly get into one's residence for safety purposes without having to fumble around trying to unlock the door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
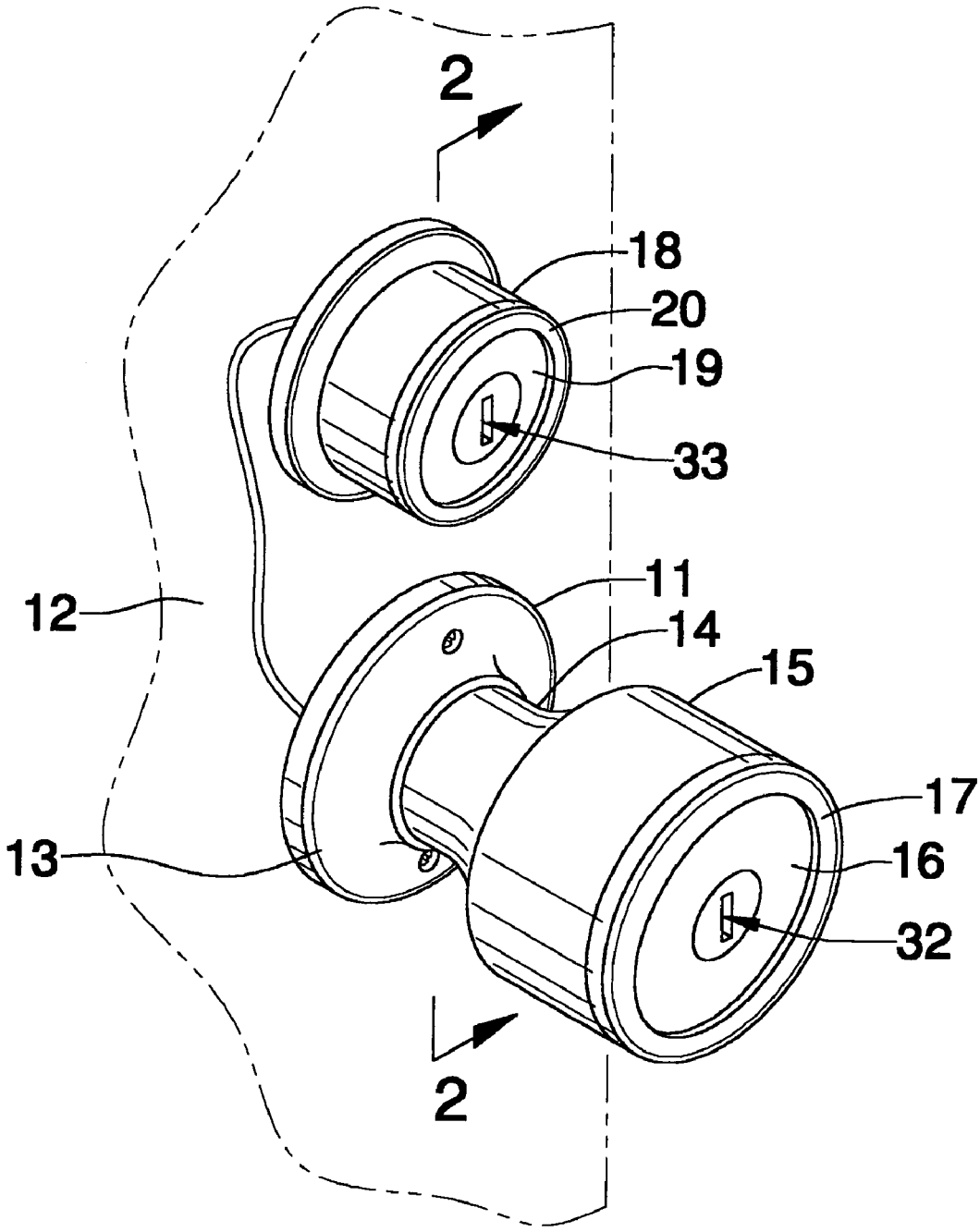
FIG. 1 is a perspective view of a new doorknob and lock light assembly according to the present invention.
Figure 2:
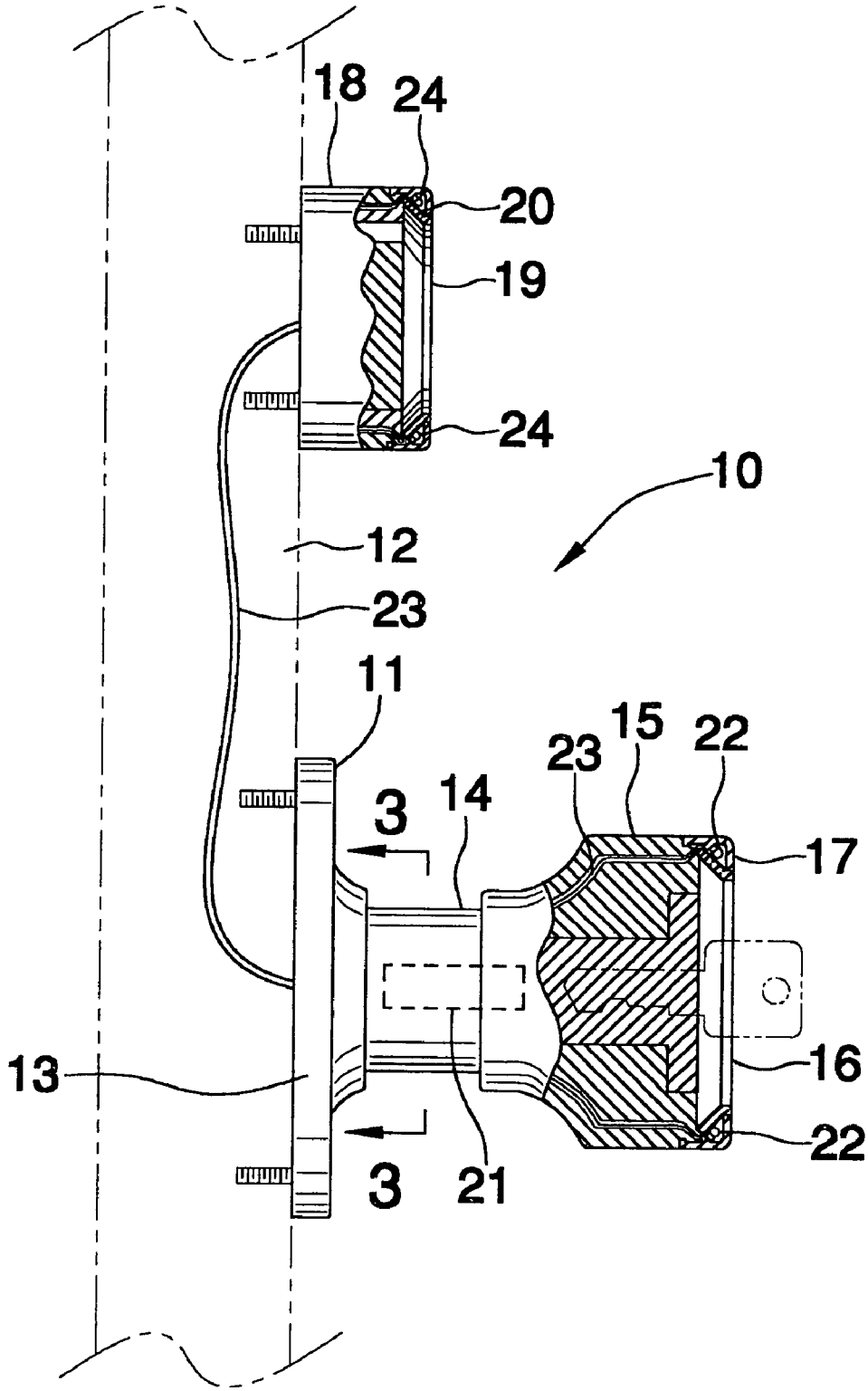
FIG. 2 is a cross-sectional view of the present invention.
Figure 3:
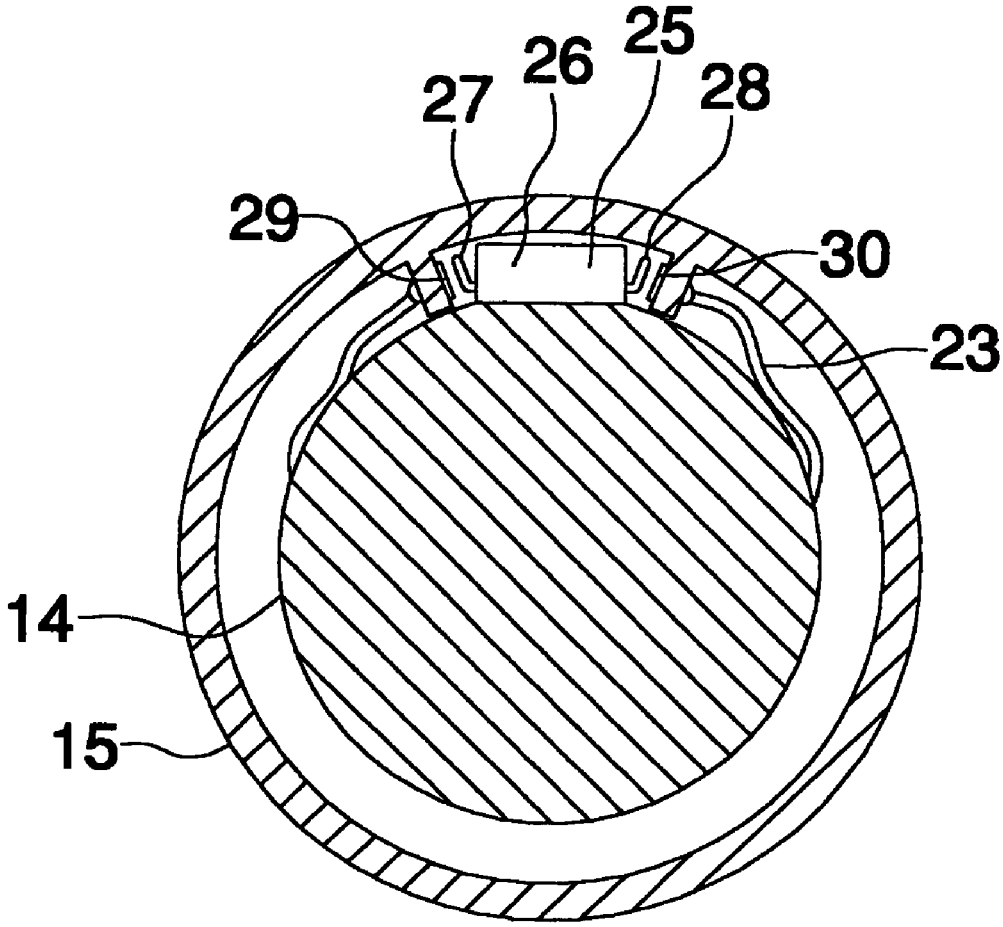
FIG. 3 is a lateral cross-sectional view of a portion of the doorknob of the present invention.
Figure 4:
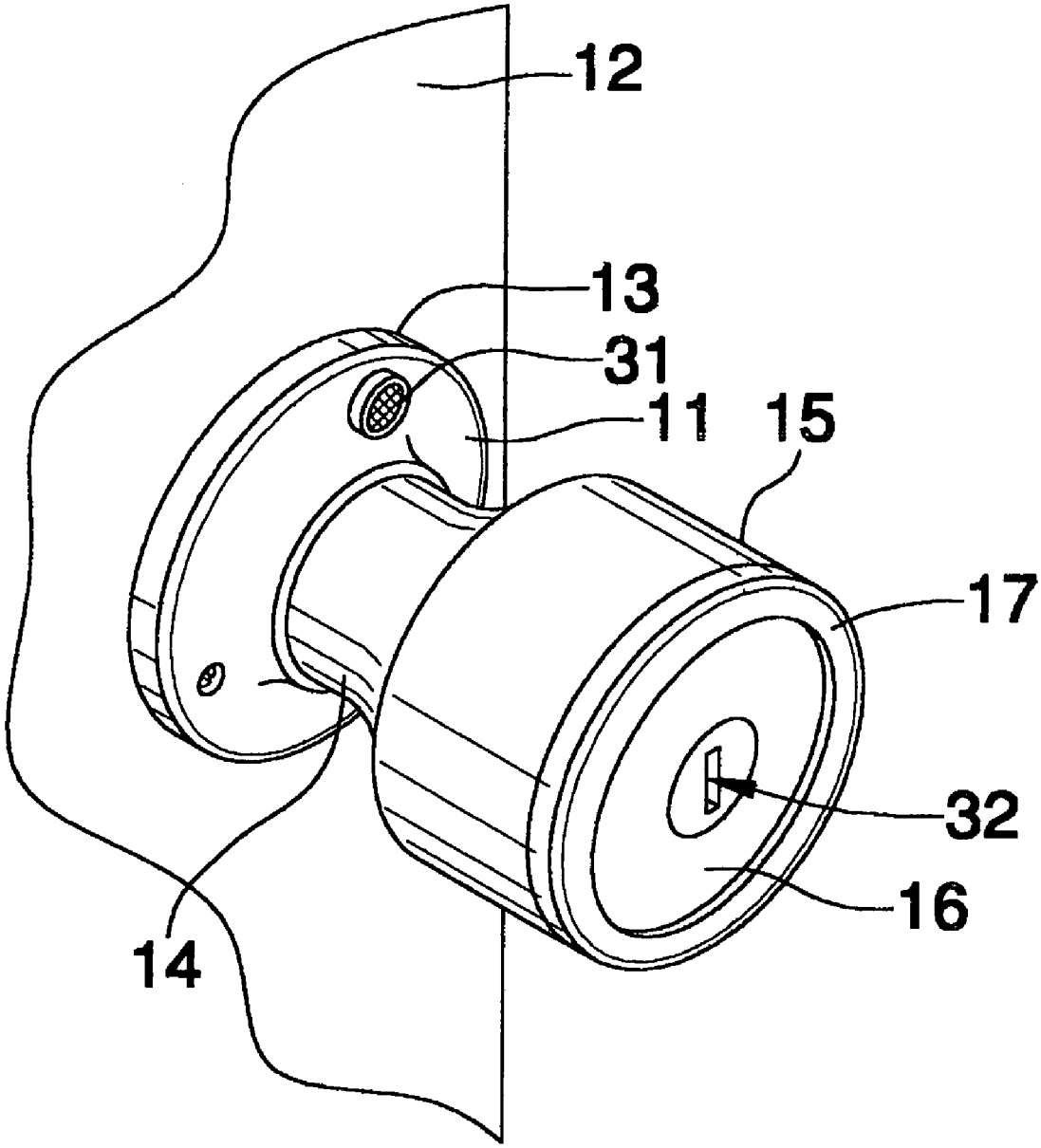
FIG. 4 is a perspective view of a second embodiment of the present invention.

With reference now to the drawings, and in particular to FIGS. 1 through 4 thereof, a new doorknob and lock light assembly embodying the principles and concepts of the present invention and generally designated by the reference numeral 10 will be described.

As best illustrated in FIGS. 1 through 4, the doorknob and lock light assembly 10 generally comprises a door lock assembly including a handle 11 being adapted to be securely attached to a door 12. The handle 11 includes a face plate 13 being conventionally fastened to the door 12, and also includes a tubular shaft 14 being rotatably disposed through the face plate 13, and further includes a doorknob 15 having a front wall 16 and a keyhole 32 being conventionally disposed through the front wall 16. The doorknob 15 includes an annular transparent window 17 being conventionally disposed in the front wall 16 thereof. The door lock assembly further includes a lock housing 18 being securely and conventionally fastened to the door 12. The lock housing 18 has a front wall 19 and an annular transparent window 20 being conventionally disposed in the front wall 19 and a key slot 33 also being conventionally disposed through the front wall 19 thereof.

A light-emitting assembly is conventionally attached to the door lock assembly and includes a battery 21 being conventionally disposed in the handle 11 and also includes light-emitting members 22 being conventionally attached to the handle 11 and being connected with wires 23 to the battery 21. The light-emitting members 22 are conventionally disposed in the doorknob 15 and are capable of emitting light through the annular transparent window 17. The light-emitting assembly also includes second light-emitting members 24 being conventionally disposed in the lock housing 18 and being capable of emitting light through the annular transparent window 20 of the lock housing 18 and being connected with wires 23 to the battery 21.

A sensor/switch assembly is conventionally attached to the door lock assembly and is conventionally connected to the battery 21. The sensor/switch assembly includes a rotary switch 25 being conventionally attached to the tubular shaft 14, and also includes contact members 29,30 being conventionally attached to the doorknob 15 and being in contactable relationship to the rotary switch 25 and being connected to the battery 21 for energizing the light-emitting members 22 upon the rotary switch 25 being rotated and coming into contact with any one of the contact members 29,30. The rotary switch 25 includes a switch body 26 being securely and conventionally attached to the tubular shaft 14 and being disposed between the contact members 29,30, and also includes angled prongs 27,28 being opposedly and conventionally attached to ends of the switch body 26 and being in contactable relationship with the contact members 29,30.

As a second embodiment, the sensor/switch assembly includes a darkness sensor 31 being conventionally disposed in the face plate 13 and being conventionally connected to the battery 21 for energizing the light-emitting members 22 at an onset of darkness.

In use, the user would grasp doorknob 15 and turn the tubular shaft 14 which would rotate the rotary switch 25 into contact with one of the contact members 29,30 thus closing the circuit and energizing the light-emitting members 22 which radiate light through the annular transparent window 20 of the doorknob to light up the area about the doorknob 15.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the doorknob and lock light assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A doorknob and lock light assembly comprising:

a door lock assembly including a handle being adapted to be securely attached to a door, said handle including a face plate being adapted to be fastened to the door, and also including a tubular shaft being rotatably disposed through said face plate, and further including a doorknob having a front wall, said doorknob including an annular transparent window being disposed in said front wall thereof, said door lock assembly further including a lock housing being adapted to be securely fastened to the door, said lock housing has having a front wall and an annular transparent window being disposed in said front wall;

a light-emitting assembly being attached to said door lock assembly and including a battery being disposed in said handle and also including light-emitting members being attached to said handle and being connected with wires to said battery; and a sensor/switch assembly being attached to said door lock assembly and being connected to said battery.

2. The doorknob and lock light assembly as described in claim 1, wherein said light-emitting assembly also includes second light-emitting members being disposed in said lock housing and being capable of emitting light through said annular transparent window of said lock housing and being connected with wires to said battery.

3. A doorknob and lock light assembly comprising:

a door lock assembly including a handle being adapted to be securely attached to a door, said handle including a face plate being adapted to be fastened to the door, and also including a tubular shaft being rotatably disposed through said face plate, and further including a doorknob having a front wall, said doorknob including an annular transparent window being disposed in said front wall thereof;

a light-emitting assembly being attached to said door lock assembly and including a battery being disposed in said handle and also including light-emitting members being attached to said handle and being connected with wires to said battery; and a sensor/switch assembly being attached to said door lock assembly and being connected to said battery, said sensor/switch assembly including a rotary switch being attached to said tubular shaft, and also including contact members being attached to said doorknob and being in contactable relationship to said rotary switch and being connected to said battery for energizing said light-emitting members upon said rotary switch being rotated and coming into contact with any one of said contact members.

4. The doorknob and lock light assembly as described in claim 3, wherein said rotary switch includes a switch body being securely attached to said tubular shaft and being disposed between said contact members, and also includes angled prongs being opposedly attached to ends of said switch body and being in contactable relationship with said contact members.

* * * * *